United States Patent [19]

Christian

[11] 4,384,953

[45] May 24, 1983

[54] GRAIN CLEANING DEVICE

[76] Inventor: Wayne Christian, Christian Farms, Inc., Rte. 1, Sherburn, Minn. 56171

[21] Appl. No.: 301,072

[22] Filed: Sep. 10, 1981

[51] Int. Cl.[3] ..... B03B 4/00

[52] U.S. Cl. ..... 209/137; 209/154

[58] Field of Search ..... 209/136, 137, 154

[56] References Cited

U.S. PATENT DOCUMENTS

| | | | |
|---|---|---|---|
| Re. 15,275 | 1/1922 | Mettler, Sr. | 209/136 |
| 21,945 | 11/1858 | Cox | 209/137 |
| 29,367 | 7/1860 | Drake et al. | 209/136 |
| 152,012 | 6/1874 | Schmitt . | |
| 375,782 | 1/1888 | Stone, Jr. | 209/34 |
| 460,731 | 10/1891 | Stone, Jr. | 209/137 |
| 548,328 | 10/1895 | Schnetzer | 209/137 |
| 619,482 | 2/1899 | Higginbottom . | |
| 806,821 | 12/1905 | Meyer . | |
| 988,765 | 4/1911 | Franklin . | |
| 1,416,489 | 5/1922 | Merzenich . | |
| 1,686,107 | 10/1928 | Sewell . | |
| 1,706,800 | 3/1929 | McWilliams et al. . | |
| 2,931,500 | 4/1960 | Andren et al. . | |
| 2,973,862 | 3/1961 | Vail | 209/136 |
| 3,058,590 | 10/1962 | Larson et al. | 209/137 |

FOREIGN PATENT DOCUMENTS

| | | | |
|---|---|---|---|
| 471273 | 2/1951 | Canada | 209/136 |
| 969730 | 9/1964 | United Kingdom | 209/136 |

*Primary Examiner*—Tim R. Miles

*Attorney, Agent, or Firm*—Darle M. Short

[57] ABSTRACT

A grain cleaning device is provided which separates foreign material from grain by aspiration. The aspiration force is developed by a fan which is attached to the grain cleaning device. The device includes a housing, a grain inlet in said housing, a louvered grain slide located within said housing, an opening within the housing which is compatible with the fan, air intake holes within the housing and adjustable covers for said air intake holes. The grain enters the grain cleaning device through the grain inlet and travels down the louvered grain slide. The fan which is located above the louvered grain slide acts as an aspirator and removes the foreign material from the grain which has a density less than the density of the grain. The foreign materials are drawn up through the fan and out an exhaust vent. The housing includes a grain slide housing and a chimney, the chimney being attached to the top of the grain slide housing. The grain slide and grain inlet are located in the grain slide housing and the fan is attached to the chimney. The grain slide extends from below the grain inlet at an angle to the bottom of the grain slide housing. The grain after being cleaned falls out of bottom of the grain slide housing into a pit, grain elevator skirt, etc.

8 Claims, 5 Drawing Figures

GRAIN CLEANING DEVICE

This invention relates to grain cleaning devices. More particularly, this invention relates to grain cleaning devices wherein the foreign materials mixed in with the grain are separated from the grain by aspiration.

BACKGROUND OF THE INVENTION

When grain is harvested and is hauled to a storage area or to the grain buyer's place of business it has many impurities mixed in with it such as grain hulls, dirt, weed seed, insects, etc. These impurities, of course, affect the quality of the grain and if the impurities are high in concentration, the buyer may dock the price it is willing to pay the seller for the grain a certain amount. Therefore, it is desired by the seller to remove as many of the impurities as possible. The seller in the above situation is usually the farmer who harvested the grain.

There are times when the farmer or a third party buyer wants to clean the grain even though the grain is not going to be involved in an immediate sales transaction. One example of this is when the grain is to be dried while it is stored. Often it is desirable to clean the grain before drying since the foreign material mixed in with the grain, if smaller than the grain, will fill the voids between the grain particles, interfering with the air flow through the grain.

If these small foreign materials are not removed from the grain before it is stored, "hot spots" may develop within the grain causing damage to the grain. Also, the drying operation is not conducted as efficiently as when the foreign material is first removed from the grain. More power per bushel of grain will be required to dry the grain if the foreign material is not first removed from the grain.

Often the third party buyer of the grain wants to remove some impurities from the grain. This may occur upon acceptance by the buyer of grain containing impurities or after grain that has been stored for a while is to be shipped and impurities such as dust have settled in with the grain during storage.

The grain must be clean of impurities for a number of reasons in addition to the reasons discussed above; to prevent the spreading of weed seed, to get a high quality grain that can be specially treated for planting, to provide a grain that is ready for processing to produce grain based products, to prevent the spreading of harmful insects, etc. Therefore, it is important to have a grain cleaning device which is effective in removing impurities from the grain passing through it.

Also, most grain handling operations are high volume operations. Therefore, it is very desirable that the grain cleaner be capable of continuous action and be able to handle a high volume of grain per time unit.

Some prior art devices have been devised for separating impurities from grain that have involved the use of air. Exemplary of these devices are the devices disclosed in the following U.S. patents:

| U.S. Pat. No. | Patentee | Date of Issuance |
|---|---|---|
| 152,012 | Schmitt | June 16, 1874 |
| 619,482 | Higginbottom | February 14, 1899 |
| 806,821 | Meyer | December 12, 1905 |
| 988,796 | Franklin | April 4, 1911 |
| 1,416,489 | Merzenich | May 16, 1922 |
| 1,686,107 | Sewell | October 2, 1928 |
| 1,706,800 | McWilliams et al | March 26, 1929 |

-continued

| U.S. Pat. No. | Patentee | Date of Issuance |
|---|---|---|
| 2,931,500 | Andren et al | April 5, 1960 |

However, none of these prior art devices put the grain in air suspension to remove impurities from the grain or regulate the air flow by air holes and adjustable covers for the air holes in the grain cleaner housing. Also, these devices do not accelerate the grain as it passes therethrough. Rather, these prior art devices use air along with some other method as the means for separating the impurities from the grain. Because of this, none of the prior art devices would be particularly effective and efficient at performing the function of removing impurities from grain.

From the above, it is apparent that there is a need in the art for a grain cleaning device which effectively and efficiently removes impurities from grain using aspiration as the only separating method. This invention fulfills this need, along with the other needs which will become apparent to the skilled artisan once given the following disclosure:

SUMMARY OF THE INVENTION

Generally speaking, this invention provides a grain cleaning apparatus for removing foreign material from grain and being designed for use with a fan, said grain cleaning apparatus comprising a housing, a grain inlet in said housing, a louvered grain slide located within said housing, said grain inlet being located at a first end of said grain slide, wherein when the grain enters the housing through the grain inlet, the grain travels down the louvered grain slide, and an opening in said housing compatible to said fan and to which the fan is attachable, said housing having a first air intake hole therein which has a first adjustable cover associated therewith, said grain cleaning apparatus being designed and arranged such that when the fan is on and as the grain travels down the grain slide the foreign material can be separated from the grain and drawn towards the fan by properly adjusting the first adjustable cover.

In some embodiments of this invention the housing includes a grain slide housing which houses the grain slide and a chimney to which the fan is attached. In these embodiments, the chimney is attached to the top of the grain slide housing over a hole in the grain slide housing so that a continuous chamber is formed by the grain slide housing and the chimney.

In other embodiments of this invention, the grain inlet is a hole located in the backwall of the grain slide housing. In these embodiments, the grain slide extends from just below the grain inlet forward at an angle down to the bottom of the grain slide housing.

The devices built according to this invention may have a plurality of air intake holes located within the housing with adjustable covers for each hole. The adjustable covers can be, of course, adjusted to any of a number of positions, from closing off their complementary air holes completely to leaving the air holes completely open and unblocked.

This invention has many advantages over the prior art. Among these advantages is the fact that the invention provides an efficient and effective grain cleaning device.

Another advantage of this invention is that the aspiration power can be easily regulated by changing the degree the air intake adjustable covers are open. This ability enables the device to be finely tuned in response to the parameters of each and every environment in which it can be employed, such as different fan sizes and speeds, ambient air conditions, etc. This feature also enables one device to be employed on a variety of types of grain.

A further advantage of this invention is that it can be built such that it is portable and can be built to almost any scale, from a small model for use on a small family farm to a model large enough to handle the volume of a large commercial grain elevator.

This invention will now be described with respect to certain embodiments thereof as illustrated in the accompanying drawings, wherein:

IN THE FIGURES

DETAILED DESCRIPTION OF THE DRAWINGS

Figures 1, 4:
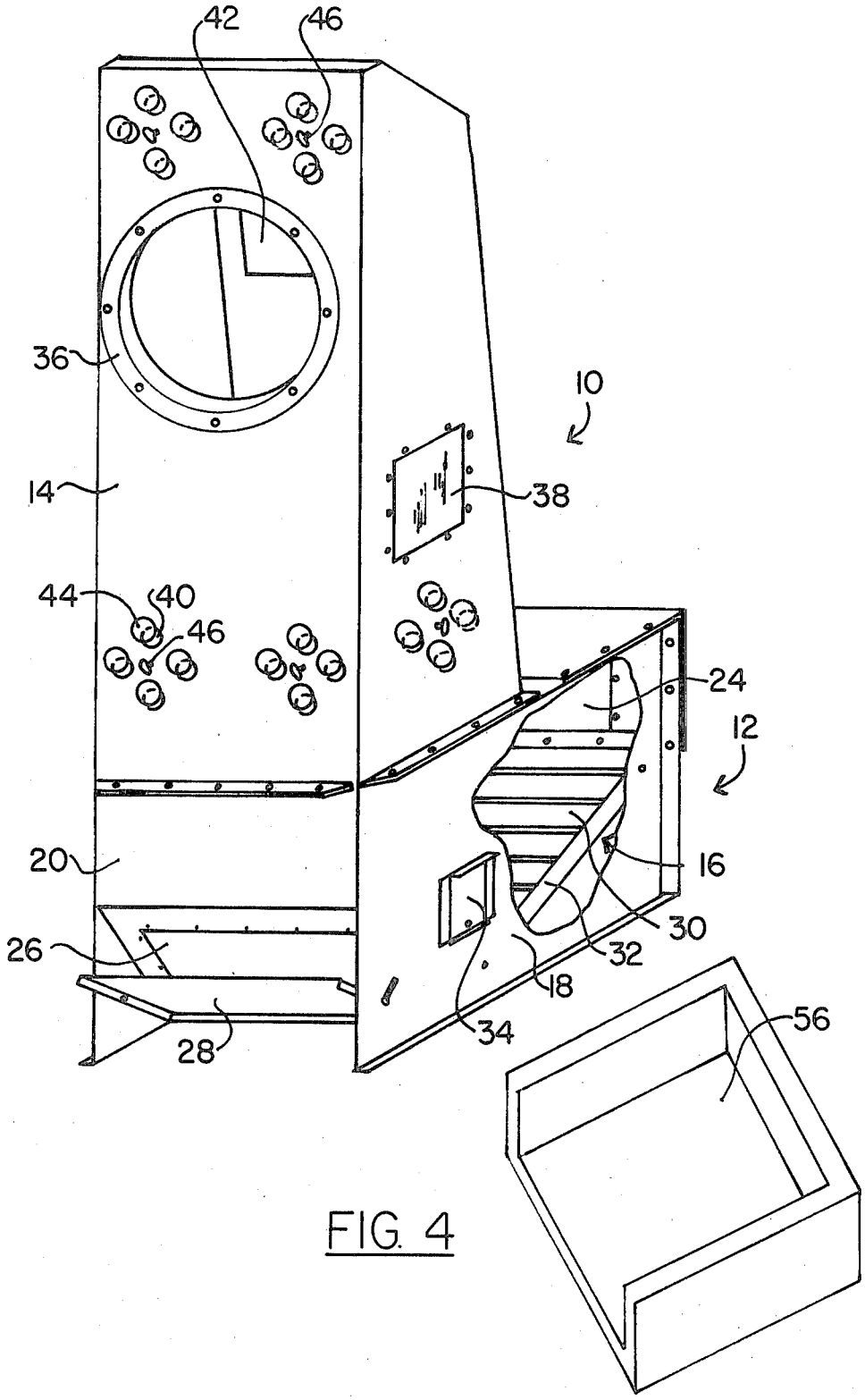
FIG. 1 is a perspective view of one embodiment of this invention.
FIG. 4 is a perspective view of one embodiment of a dead box which can be employed in the practice of this invention.
Figure 3:
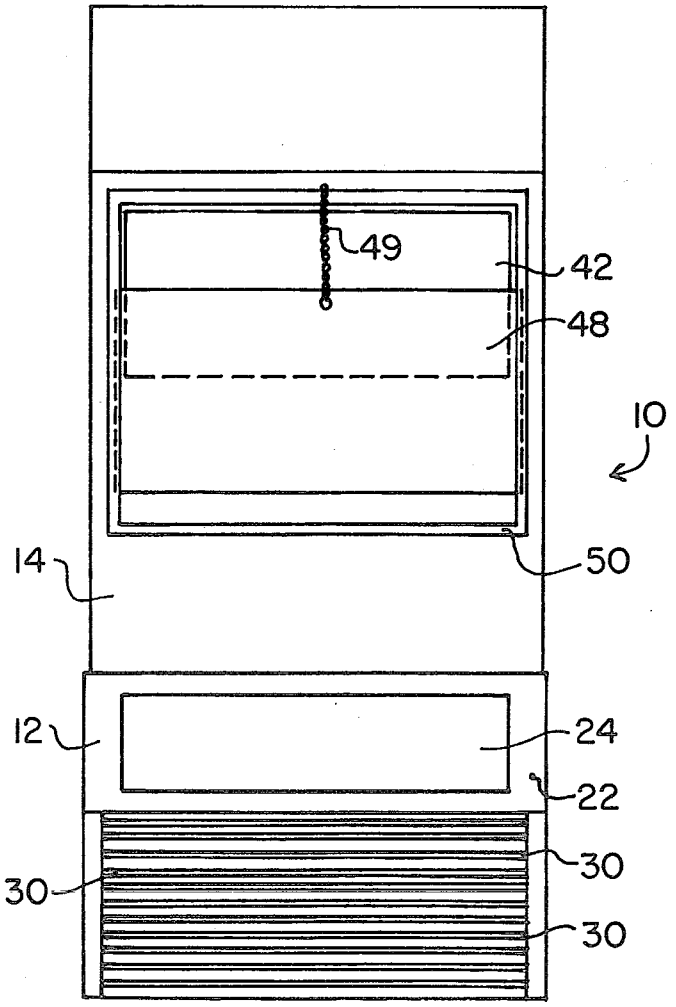
FIG. 3 is a rear view of the embodiment of this invention illustrated in FIG. 2.

Referring to the Figures, grain cleaner 10 includes grain slide housing 12 and chimney 14. Chimney 14 is attached to the top of grain slide housing 12 at one end of grain slide housing 12. Grain slide housing 12 has an opening in the top which is compatible with the opening in the bottom of chimney 14 so that a continuous chamber is formed between grain slide housing 12 and chimney 14. In the embodiment of the invention illustrated in the Figures, grain slide housing 12 and chimney 14 are both comprised of sheet metal.

Grain slide housing 12 includes side walls 18, front wall 20 and back wall 22 and houses louvered grain slide 16. Note that grain slide housing 12 does not have a bottom surface. The opening in the bottom of grain slide housing 12 at the lower end of grain slide 16 acts as the grain outlet. If the opening in the bottom of grain slide 16 is larger than the pit opening, skirt of a grain elevator, etc. into which the grain goes after it goes through grain cleaner 10, a partial bottom surface could be provided. If a partial bottom surface is provided, it is desired that it be slanted towards the pit opening, grain elevator skirt, etc. so that grain does not built up within grain cleaner 10.

Back wall 22 extends from the top of grain slide housing 12 about halfway down grain slide housing 12 and has grain inlet opening 24 therein. Grain inlet opening 24 is designed to be compatible with the grain feeder means which will be employed to feed grain into grain cleaner 10 or with dead box 56 (shown in FIG. 4). Dead box 56 is designed to be employed whenever the grain feeder means available for use will tend to feed the grain into grain cleaner 10 at too rapid a speed for grain cleaner 10 to properly function. Dead box 56 is designed to slow down the grain before it enters grain cleaner 10 for reasons later discussed. When dead box 56 is employed, the grain feeds directly into dead box 56 which in turn feeds the grain into grain inlet opening 24.

Front wall 20, of the embodiment of this invention illustrated in the figures, extends from the top to the bottom of grain slide housing 12, however, it includes a flat approximately vertical section which comprises the top half of front wall 20 and an inwardly sloped section which comprises the bottom half of front wall 20. Located in the bottom half of front wall 20 is screened air vent 26. Screened air vent 26 has an adjustable cover 28 which can be adjusted in a plurality of positions to regulate the air taken in thru screened air vent 26.

Figure 5:
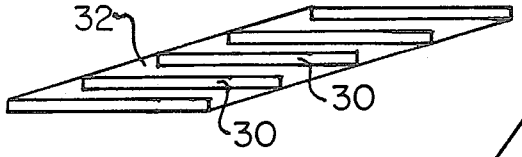
FIG. 5 is a partial side of one embodiment of a louvered grain slide that can be employed in the practice of this invention, with one side member being removed for clarity.

Grain slide 16 includes spaced slats 30 and side members 32. Side members 32 are attached to and run along side walls 18. Slats 30 extend between the two side members 32 and are either approximately horizontal or are angled downward at a small angle. Side members 32, and thus grain slide 16, extend at an angle from just below grain inlet opening 24 to the bottom of grain slide housing 12, a short distance from the bottom edge of front wall 20. Slats 30, in some embodiments of this invention, overlap adjacent slats as shown in FIG. 5.

One or both of the side walls 18 has a sample door 34 attached thereto which can be opened to collect samples of the grain as it passes thru grain slide housing 12.

Chimney 14 has fan mounting member 36 attached to an opening therein, viewing window 38 attached thereto and air intake holes 40 and 42 therein. Fan mounting member 36 is designed such that grain aeration fan 52 can be attached to chimney 14. Grain aeration fan 52 is attached to chimney 14 such that it is blowing air away from chimney 14. Viewing window 38 is a plate of glass or a transparent plastic through which the grain cleaning process can be viewed during the employment of grain cleaner 10.

Air intake holes 40, in the embodiment of the invention illustrated in the Figures, are arranged in sets of four at selected locations in chimney 14. Adjustable covers 44 for air intake holes 40 are attached to chimney 14 and can be rotated by turning knobs 46 to leave open as much of holes 40 as desired.

Air intake hole 42 is located in the back of chimney 14 and can be closed by sliding door 48 which is slidably located in track 50. Sliding door 48 can be secured by chain 49 so that it does not obstruct air intake hole 42, so that it completely closes off air intake hole 42, or at any position between these two extremes.

The embodiment of this invention illustrated in the Figures is employed as follows. First grain cleaner 10 is placed over the pit, receptable, elevator skirt, etc., into which the grain is to run after it has been cleaned. Grain aeration fan 52 is then attached to fan mounting member 36 and the grain feeder device is placed in alignment with grain inlet opening 24 or, in the alternative, dead box 56 is attached to grain inlet opening 24.

Grain aeration fan 52 is then turned on and grain is fed into grain cleaner 10 by the grain feeding means either directly into grain inlet opening 24, or thru dead box 56 if it is desired to slow the grain down before it enters grain cleaner 10. The grain will travel down grain slide 16 accelerating as it goes down grain slide 16. The grain will be accelerated by air drawn through the slats 30 of grain slide 16. Fan 52 will draw air into the chimney from air intake holes 40 and 42, air vent 26, and the bottom of grain slide housing 12. The drawing of air through these various openings forms an approximate "dead spot" in which the grain passes through when it travels down grain slide 16. This movement of air will create a force in the "dead spot" attracting the grain and the impurities mixed up with the grain towards fan 52 and impurities exhaust 54. The magnitude of this force can be adjusted by varying the amount adjustable covers 28 and 44 and sliding door 48 are open or closed.

The adjustable covers 38 and 44 and sliding door 48 are positioned such that individual kernels, beans, etc. of the grain and the foreign material mixed in with the grain are placed in suspension as they pass down grain slide 16. When covers 38 and 44 and the door 48 are properly adjusted, the grain will continue down the grain slide 16 out the bottom of grain slide housing 12 while the impurities that have a density less than the grain will be drawn towards fan 52 and out foreign material exhaust 54.

It is important in the practice of some embodiments of this invention that the grain is accelerating as it goes down the grain slide. This contributes to the effectiveness of these embodiments.

Once given the above disclosure, many other embodiments, improvements and modifications will become apparent to the skilled artisan. Such other embodiments, improvements and modifications are considered to be within the scope of this invention as defined by the following claims:

I claim:

1. A grain cleaning apparatus for removing foreign material from grain and being designed for use with a fan, said grain cleaning apparatus comprising:

a housing including a grain slide housing and a chimney, said chimney being attached to the top of said grain slide housing, said chimney having means for receiving said fan, said grain slide housing having a back wall, a grain inlet in said back wall, a louvered grain slide located within said grain slide housing, said grain inlet being located at a first end of said grain slide, said grain slide extending at an angle between said grain inlet and the bottom of said grain housing, wherein when the grain enters the housing through the grain inlet, the grain travels over the louvered grain slide, said housing having a first air intake hole therein which has a first adjustable cover associated therewith, wherein said first air intake hole is located in the front of the grain slide housing and wherein said first adjustable cover is compatible with said first air intake hole, said grain cleaning apparatus being designed and arranged such that when the fan is on and as the grain travels over the grain slide foreign material can be separated from the grain and drawn towards the fan by properly adjusting the first adjustable cover, said apparatus being designed and arranged such that a straight line connecting the center points of the first air intake hole and the fan receiving means does not cross said louvered grain slide, wherein a substantial portion of the air flow from the first air intake hole to the fan does not go through said grain slide, wherein the grain slide, fan receiving means and first air intake hole are designed and arranged such that the grain and foreign material are accelerated by the air flow generated by the fan as the grain and foreign material pass over the grain slide.

2. A grain cleaning apparatus according to claim 1 wherein said grain slide is comprised of a plurality of slats, said slats being roughly horizontal and overlapping adjacent slats.

3. A grain cleaning apparatus according to claim 1 wherein said first air intake hole is located adjacent the lower end of said grain slide, said first intake hole being in approximately the same vertical planes as said fan receiving means.

4. A grain cleaning apparatus according to claim 1 further comprising sets of second air intake holes located in the housing thereof and sets of second adjustable covers, said second air intake holes being located at selected locations in said chimney, said second adjustable covers being attached to said chimney such that they can be positioned to cover up said second air intake holes.

5. A grain cleaning apparatus according to claim 4 wherein the grain slide housing forms a horizontal chamber, said chimney being attached to the front top portion of said grain slide housing.

6. A grain cleaning apparatus according to claim 5 further comprising a third air intake hole located in the face of the chimney opposite of the face to which the fan is attached, and, a sliding door that is slidably attached to said chimney and can be adjusted to cover all or a portion of said third air intake hole.

7. A grain cleaning apparatus according to claim 6 wherein said grain cleaning apparatus is designed and arranged such that as grain is travelling down said grain slide, said first, second and third adjustable covers can be adjusted to place the grain in suspension and remove material of a less density than the grain up thru the fan.

8. A grain cleaning apparatus according to claim 7 further comprising means for showing the grain particles down before the grain enters the grain cleaning apparatus.

* * * * *

UNITED STATES PATENT AND TRADEMARK OFFICE

CERTIFICATE OF CORRECTION

PATENT NO. : 4,384,953

DATED : May 24, 1983

INVENTOR(S) : Wayne Christian

It is certified that error appears in the above-identified patent and that said Letters Patent is hereby corrected as shown below:

Column 5, line 10, "38" should read -- 28 --.

Column 6, line 52, "showing" should read -- slowing --.

Figure 2:
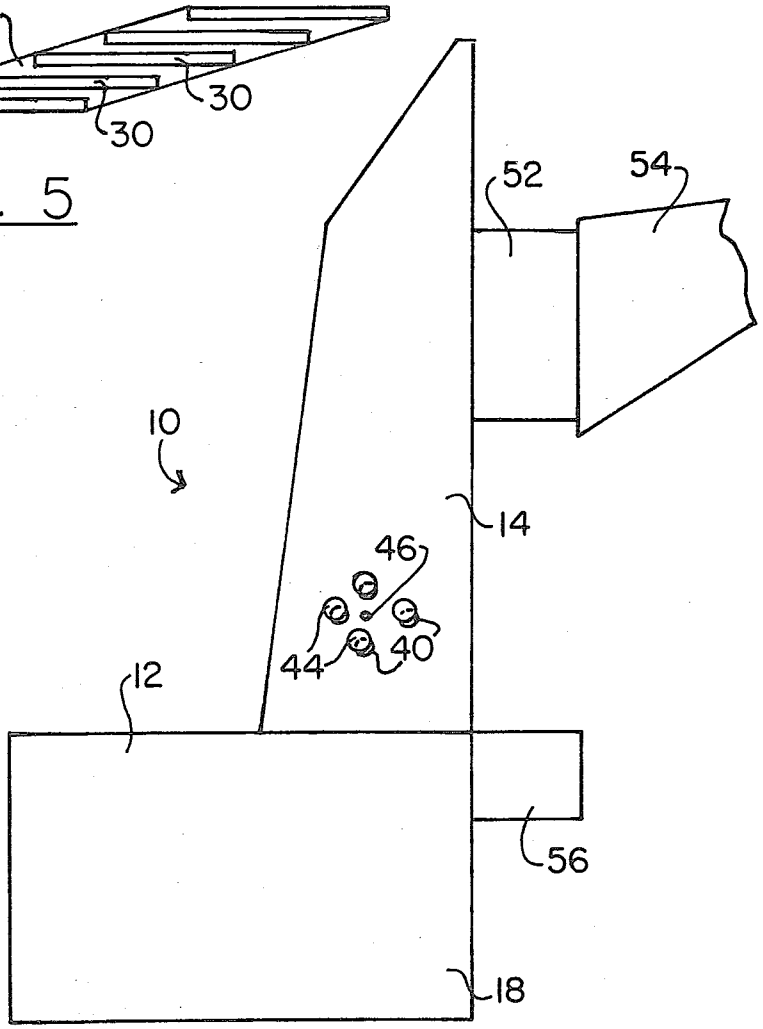
FIG. 2 is a side view of the embodiment of this invention illustrated in FIG. 1.

Figure 2 of the drawings should be deleted to appear as per attached Figure.

Signed and Sealed this

*Sixth* Day of *September 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,384,953

DATED : May 24, 1983

INVENTOR(S) : Wayne Christian

It is certified that error appears in the above-identified patent and that said Letters Patent is hereby corrected as shown below:

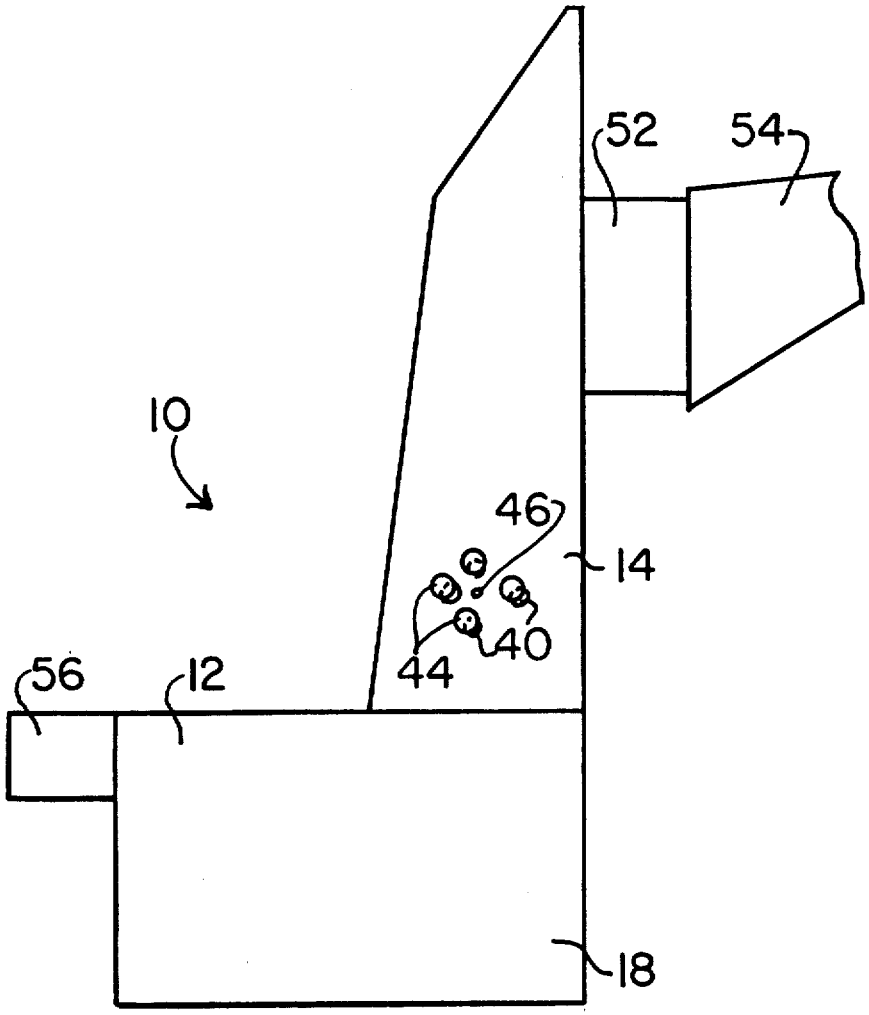

FIG. 2